US006295836B1

(12) United States Patent
Nguyen et al.

(10) Patent No.: US 6,295,836 B1
(45) Date of Patent: Oct. 2, 2001

(54) CRYOGENIC AIR SEPARATION SYSTEM WITH INTEGRATED MASS AND HEAT TRANSFER

(75) Inventors: Tu Cam Nguyen, Falcon Heights, MN (US); Bayram Arman; Dante Patrick Bonaquist, both of Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/549,602

(22) Filed: Apr. 14, 2000

(51) Int. Cl.[7] ..... F25J 3/00
(52) U.S. Cl. ..... 62/643; 62/903
(58) Field of Search ..... 62/643, 646, 903, 62/644

(56) References Cited

U.S. PATENT DOCUMENTS

| | | | |
|---|---|---|---|
| 5,144,809 | 9/1992 | Chevalier et al. | 62/36 |
| 5,275,004 | 1/1994 | Agrawal et al. | 62/24 |
| 5,410,885 | 5/1995 | Smolarek et al. | 62/25 |
| 5,463,871 | 11/1995 | Cheung | 62/38 |
| 5,592,832 | 1/1997 | Herron et al. | 62/646 |
| 5,596,883 | 1/1997 | Bernhard et al. | 62/618 |
| 5,694,790 | 12/1997 | Lavin | 62/640 |
| 5,699,671 | 12/1997 | Lockett et al. | 62/63 |
| 5,724,834 | 3/1998 | Srinivasan et al. | 62/643 |
| 5,899,093 * | 5/1999 | Ha | 62/643 |
| 5,901,578 * | 5/1999 | Wong et al. | 62/646 |

* cited by examiner

*Primary Examiner*—William Doerrler
(74) *Attorney, Agent, or Firm*—Stanley Ktorides

(57) ABSTRACT

A cryogenic air separation system comprising an integrated core and typically including a double column wherein incoming feed air is cooled in the core which also processes a stream from the double column. A separating section of the core processes a stream from the double column to form product.

4 Claims, 10 Drawing Sheets

CRYOGENIC AIR SEPARATION SYSTEM WITH INTEGRATED MASS AND HEAT TRANSFER

FIELD OF THE INVENTION

This invention generally relates to cryogenic air separation and, more particularly, to the integration of various levels of heat-transfer and mass-transfer in order to enhance thermodynamic efficiency and to reduce capital costs.

BACKGROUND OF THE INVENTION

Cryogenic air separation systems are known in the art for separating gas mixtures into heavy components and light components, typically oxygen and nitrogen, respectively. Generally, the separation process takes place in plants that cool incoming mixed gas streams through heat exchange with other streams (either directly or indirectly) before separating the different components of the mixed gas through mass transfer methods such as distillation and/or reflux condensation (dephlegmation). Once separated to achieve desired purities, the different component streams are warmed back to ambient temperature. Typically, the different warming, cooling, and separating steps take place in separate pieces of equipment, which, along with the installation and piping, adds to the manufacturing costs for the plant.

Various air separation systems have been introduced that combine some of the separate heat transfer components in order to provide an integrated device that may perform a variety of functions. In particular, systems have been proposed that partially combine different heat exchangers for warming or cooling fluid streams and separation devices for separating out heavy and light components in the streams into a single heat exchange core in order to reduce the number of pieces of equipment needed in an air separation plant. This may reduce the overall cost of the plant.

SUMMARY OF THE INVENTION

The present invention is directed to an air separation system with a unique integration design that provides a single brazed core that can combine separation networks with a host of heat exchange functions.

Increasing the total cross section of a heat transfer core provides a greater opportunity for heat transfer between streams, thus increasing efficiency. This improvement may come at an attractive cost per unit area of heat transfer.

The present invention also reduces the capital costs associated with air separation systems (particularly the cold boxes of cryogenic air separation systems) and increases overall thermodynamic efficiency by utilizing designs that optimally combine mass-transfer functions with heat-transfer functions in a single core which results in the reduction or elimination of a significant amount of interconnecting piping and independent supporting structures and cold box volume thereby reducing piping and installation costs. Typically, the integrated core is used to (i) cool the process feed air down to a cryogenic temperature, (ii) boil the heavy component product (typically liquid oxygen), and (iii) superheat/subcool various process streams. Preferably, the integrated core is a brazed plate-fin core made of aluminum. The integrated core may include a plurality of passages arranged so as to effectively combine the various levels of heat-transfer, as well as different levels and types of mass-transfer (such as rectification and stripping).

In a preferred design of the present invention, an integrated core is provided in flow communication with a double column separation apparatus having a higher pressure column (generally termed the lower column) and a lower pressure column (generally termed the upper column). The double column separation apparatus may be of any conventional design that provides separation of heavy and light components from various vapor streams.

In a preferred design, the integrated core includes a first set of intake passages (although, it should be recognized that only one passage for each stream in the system is required to achieve the benefits of the present invention) in which an incoming feed air stream is cooled and then directed into the double column separation apparatus (typically the lower column). The cooling is preferably accomplished by positioning the first set of intake passages in a heat exchange relationship with at least one other passage in the integrated core. In variations of this embodiment, the first set of intake passages may include a section for mass transfer, in which a condensate in the passage serves as reflux to rectify the feed air stream. In this case, the first intake passages will form a condensate stream that may be directed into the upper column.

A first set of cooling passages cools a first bottom stream from the separation apparatus (typically the lower column) and feeds the cooled, first bottom stream back into the separation apparatus (typically the upper column). The first set of cooling passages may be in a heat exchange relationship with at least one other passage (or set of passages) in the integrated core.

A first set of warming passages warms a first overhead stream from the separation apparatus (preferably the upper column) and discharges the warmed first overhead stream from the integrated core. The first set of warming passages may be in a heat exchange relationship with at least one other set of passages in the integrated core.

A separating section (preferably a stripping column) in the integrated heat exchanger core separates a second bottom stream from the separation apparatus (preferably from the upper column external to the integrated heat exchanger core) to form an oxygen enriched stream and a nitrogen enriched stream. The nitrogen enriched stream may be directed back into the separation apparatus (preferably into the upper column). Preferably, the oxygen stream is separated into a vapor phase stream and a liquid phase stream by a phase separator. The vapor phase stream typically is directed back into the separating section. In preferred embodiments, the separating section is integrated within the integrated core and the separating apparatus is external to the integrated core. In addition, a pump may be provided to pump the liquid phase through the integrated core.

A set of vaporization passages vaporizes the liquid phase stream from the phase separator and discharges the vaporized liquid phase stream from the integrated core. The vaporization passages may be in heat exchange relationships with at least one other set of passages of the integrated core.

The integrated core may also include a second set of cooling passages that cools a condensed stream from the upper column and directs the cooled, condensed stream back into the separation apparatus (typically into the upper column). As with the first set of cooling passages, the second set is preferably in a heat exchange relationship with at least one other set of passages in the integrated core.

The integrated core may also include a second set of warming passages that warms a second overhead stream from the stripping apparatus (preferably from the lower pressure column) and discharges the warmed second overhead stream from the integrated core. The second set of warming passages may also be in a heat exchange relationship with at least one other set of passages in the integrated core.

A fourth set of warming passages may be provided to warm the oxygen enriched stream from the separating section and to direct the oxygen enriched stream into the phase separator. These passages may also be in heat exchange relationships with any number of other passages in the integrated core.

The integrated core may also include a second set of intake passages that cools a second incoming feed air stream and directs the cooled, second incoming feed air stream into the separation apparatus (preferably into the lower column). The second set of intake passages may be in a heat exchange relationship with at least one other set of passages in the integrated core.

The integrated core may also include a third set of intake passages that cools a third incoming feed air stream and directs the cooled, third incoming feed air stream into the separation apparatus (preferably into the lower pressure column). The third intake passages may be in heat exchange relationships with any number of other passages in the integrated core, but preferably exchange heat with the first set of warming passages and/or the second set of warming passages. In alternative embodiments, the third set of intake passages may cool a refrigerated air stream received from a refrigeration unit. In such an embodiment, the integrated core may also include a fourth set of warming passages to warm the refrigerated air stream cooled in the third set of intake passages against other passages in the integrated core and to discharge the refrigerated air stream from the integrated core back into the refrigerated unit.

Although the sets of passages may be designed so as to have various heat exchange interactions with other sets of passages within the integrated core, it is preferred that the first set of intake passages and the second set of intake passages share heat exchange relationships with any of the first set of warming passages, the second set of warming passages, the fourth set of warming passages, and the set of vaporization passages. Additionally, the first set of cooling passages and the second set of cooling passages may share heat exchange relationships with, at least, any of the first, second, and fourth sets of warming passages.

Generally, the integrated core is divided into a warm end, including openings in the integrated core for flow into and out of the intake passages and the warming passages, and a cold end, including the separation section. Typically, the warm end is the top end of the integrated core and the cold end is the bottom end; however, the integrated core may be designed so that the bottom end is the warm end (including the openings for the intake and warming passages) and the top end is the cold end (including the separation section).

In another embodiment of the present invention, the integrated core may stand alone, without using a double column separation system, in order to produce light component products. In this embodiment, the air separation system may include a rectification section (or other separation section) that rectifies an incoming feed air stream to form an overhead stream enriched in nitrogen, and a bottom stream enriched in oxygen. The rectification section may utilize any conventional design for rectifying mixed fluid streams. In more preferred embodiments, the rectification section is integrated within the integrated core; however, an air separation system may be designed such that the rectification section is outside of, but in flow communication with, the integrated core.

The integrated core of this embodiment includes a first set of cooling passages that cools the incoming feed air stream and feeds the cooled, incoming feed air stream into the rectification section. A second set of cooling passages cools the bottom stream from the rectification section. A first set of warming passages warms a first portion of the overhead stream and directs the warmed portion of the overhead stream back into the rectification section. The first set of warming passages may be in a heat exchange relationship with at least one of the sets of cooling passages. A second set of warming passages warms a second portion of the overhead stream and discharges the warmed second portion of the overhead stream from the integrated core. The second warming passages may also be in heat exchange relationships with any of the cooling passages. A set of vaporization passages vaporizes the cooled bottom stream from the second cooling passages and discharges the vaporized bottom stream from the integrated core. The vaporization passages may be in heat exchange relationships with any of the cooling passages. In preferred embodiments, the cooled bottom stream is expanded by a turboexpander.

In yet another embodiment of the present invention, an air separation system may include a double column separation apparatus, a rectification column (or other separation column), and an integrated core in which is included the lower column from the double column separation apparatus.

The integrated core of this embodiment includes a first set of intake passages that cools a first incoming feed air stream. The first incoming air stream may be directed into the separation apparatus of the lower column, depending on the design particulars. The integrated core may also include a second set of intake passages that cools a second incoming feed air stream and feeds the cooled, second incoming feed air stream into the double column separation apparatus (typically into the upper column). The lower column of the separating apparatus produces a first overhead stream enriched in nitrogen and a first bottom stream enriched in oxygen.

The integrated core may also include a first set of cooling passages that cools the first bottom stream from the lower column and feeds it back into the separation apparatus, typically into the upper column.

The upper column may separate streams it receives from the separation apparatus and/or the integrated core to produce a second bottom stream, which may be enriched in oxygen, and a second overhead stream enriched in nitrogen.

Preferably, a second set of cooling passages are provided in the integrated core to cool the second bottom stream from a condenser in the upper column and to feed the second bottom stream back into the double column separation apparatus (typically into the upper column). The second cooling passages may be in heat exchange relationships with any passages warming streams in the integrated core.

A first set of warming passages warms the first overhead stream from the lower column and discharges at least a portion of the warmed first overhead stream from the integrated core. The remainder of the warmed first overhead stream may be condensed by a condenser in the upper column. The first set of warming passages may be in heat exchange relationships with any passage for cooling a stream in the integrated core.

The integrated core may also include a second set of warming passages that warms a second overhead stream from the lower pressure column. The second warming passages may also be in heat exchange relationships with any of the cooling passages of the integrated core.

A third set of warming passages may be provided to warm a third bottom stream from the separating column (either upper column or integrated heat exchanger column) and to discharge that stream from the integrated core. Typically, the third warming passages are in heat exchange relationships with any of the cooling passages.

In another embodiment of the present invention, an air separation system may include two integrated cores in flow communication with each other. Preferably, the air separation system incorporates a double column arrangement, with the lower and upper pressure columns being integrated in the different integrated cores.

The first integrated core may include a first set of intake passages that cools a first feed air stream, although additional intake passages may be provided to receive other feed air streams as necessary. When a second set of intake passages is incorporated into the first integrated core, those passages may cool a second feed air stream. Typically, the second set of intake passages feeds its air stream into a first separation section (discussed below). In more preferred embodiments, a portion of the second feed air stream from the second intake passages may be expanded and fed into the first set of intake passages.

A first separation section may separate the cooled first feed air stream into a first overhead stream enriched in nitrogen and a first bottom stream enriched in oxygen. The first separation section is preferably the lower column of the double column separation system. A first set of cooling passages cools the first bottom stream from the first separation section.

A set of vaporization passages vaporizes a liquid phase stream from the second integrated core (discussed below) and discharges the vaporized liquid phase stream from the integrated core. The vaporization passages may be in heat exchange relationships with any of the intake passages and the first cooling passages.

A first set of warming passages warms a second overhead stream (preferably from the upper column in the second integrated core) and discharges the warmed second overhead stream from the first integrated core. The first warming passages may be in a heat exchange relationship with any of the intake passages and the first cooling passages.

The second integrated core may include a second set of warming passages that warms the first overhead stream from the first separation section and feeds the warmed first overhead stream back into the first separation section (i.e., reflux for the lower column). A second separation section (the upper column) receives at least one cooled stream and separates that stream into the second overhead stream enriched in nitrogen and a second bottom stream enriched in oxygen. A third set of warming passages warms the second overhead stream and feeds the warmed second overhead stream into the first warming passages. The third warming passages may be in heat exchange relationships with any cooling (including intake) passages of the integrated core.

A fourth set of warming passages may be provided to warm (and partially vaporize) the second bottom stream. The warmed second bottom stream may be separated, using a phase separator, into a vapor phase stream and the liquid phase stream. The liquid phase stream may be fed into the vaporization passages and the vapor phase stream may be fed back into the second separation section. Preferably, the liquid phase is pumped into the vaporization passages. The fourth warming passages may be in heat exchange relationships with any of cooling passages (including intake passages) of the integrated core.

The second integrated core may also include a fifth set of warming passages that warms a third overhead stream from the second separation section and discharges the warmed third overhead stream from the second integrated core. A sixth set of warming passages may be provided in the first integrated core to receive and to discharge from the first integrated core the third overhead stream from the fifth warming passages, while warming the stream against at least one other stream in the first integrated core.

In some embodiments, the second integrated core may also include a second set of cooling passages for cooling the first bottom stream from the first cooling passages. In addition, a third set of cooling passages may cool the second feed air stream from the second intake passages. A fourth set of cooling passages may receive and cool a portion of the warmed first overhead stream from the second warming passages before that portion is fed back into the first separation section. The second separation section (i.e., upper column) may separate any of the streams from the second, third, and fourth cooling passages. In addition, the second, third and fourth sets of cooling passages may provide cooling by being in heat exchange relationships with any of the warming passages in the second integrated core, particularly the second warming passages.

However, the air separation system may not necessarily include the second cooling passages, third cooling passages, or fourth cooling passages, at least as described above, if an additional separation section is incorporated into the second integrated core. For instance, the air separation system of this embodiment (having two integrated cores) may also incorporate an argon separation section, which preferably may be integrated into the second integrated core. When an argon rich stream is to be produced, the second separation section may be modified to produce a first argon-rich stream.

The argon separation section further separates the first argon-rich stream into a second argon-rich stream and an argon-depleted stream. At least a portion of the second argon-rich stream is discharged from the second integrated core as a first argon product stream.

A reboiler/condenser section may be provided in the second integrated core and includes a condensing passage in a heat exchange relationship with a boiling passage. A portion of the cooled first bottom stream may be condensed in the condensing passage. A portion of the second argon-rich stream typically is boiled in the boiling passage. At least a portion of the boiled second argon-rich stream may be fed back into the argon separation section for reflux. The remainder of the boiled second argon-rich stream may be discharged from the second integrated core as a second product argon stream.

DETAILED DESCRIPTION OF THE PREFERRED EMBODIMENTS

Figure 1A:
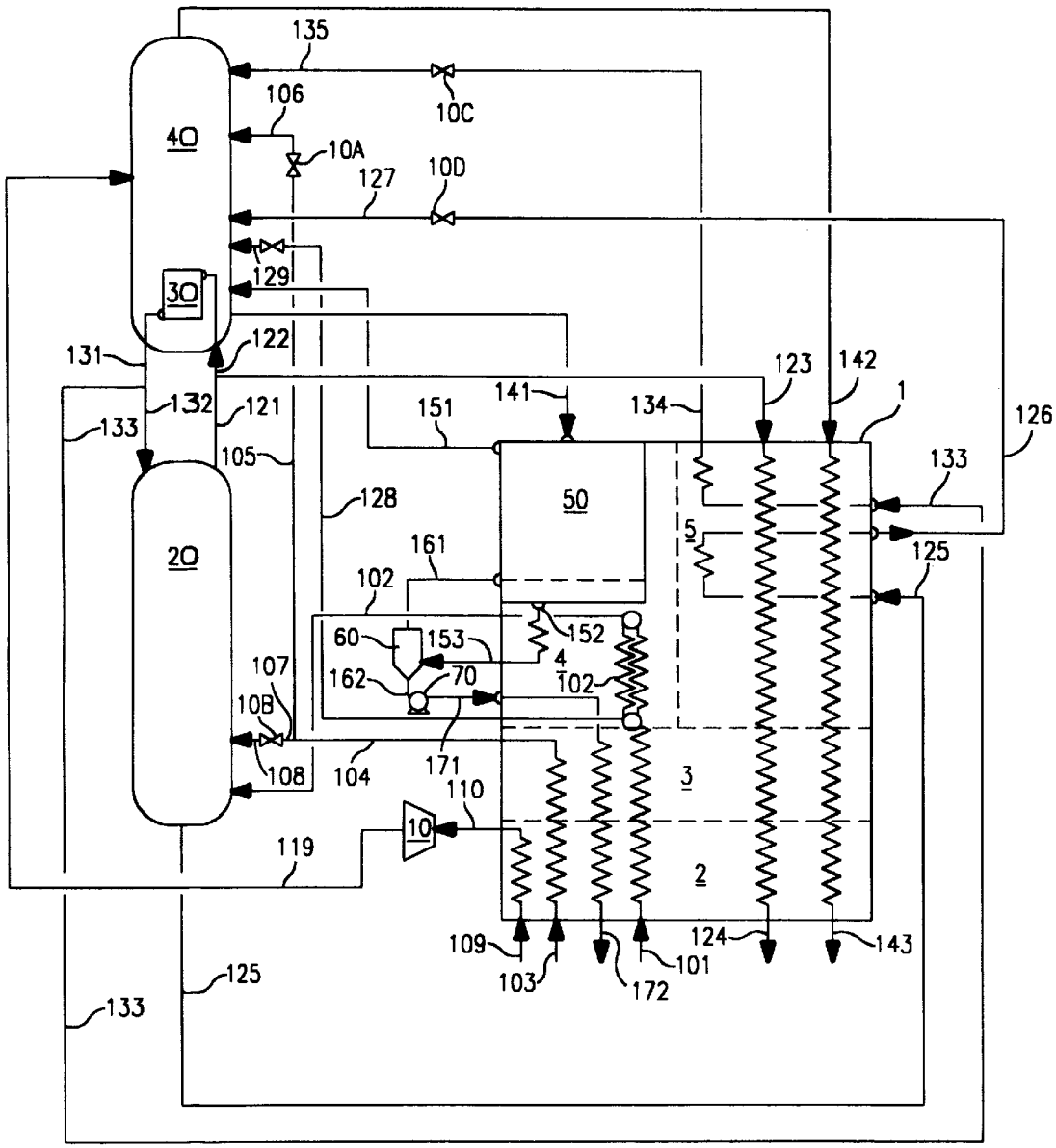
FIG. 1A shows a first embodiment of an air separation system of the present invention that includes an integrated core with a side stripping column.

FIG. 1A depicts a preferred embodiment of the present invention, and generally shows a cryogenic air separation system utilizing an integrated heat exchange core with a double column separation apparatus for producing low purity oxygen. The system is arranged with the cold end up. An auxiliary reboiled stripping section or side stripper 50, used in an air separation process to produce a low purity oxygen product (preferably from about 50 to about 95% purity), is integrated within the heat exchange core. The double-column separation apparatus may be of any conventional type and, in this case, includes a lower column 20 and an upper column 40, both of which are in flow communication with each other and integrated core 1.

To facilitate heat transfer among various fluid streams in the system, the heat transfer section of integrated core 1 may utilize a plate-fin design, wherein passages throughout integrated core 1 have finned passages that allow fluid streams to flow through integrated core 1 in heat exchange relationships with fluid streams in other passages. It is preferred that the plate-fin system be constructed of aluminum to facilitate heat transfer and to keep costs low. Preferably, all of the heat exchange sections of integrated core 1 are incorporated in a single brazed aluminum core.

Integrated core 1 receives low pressure air stream 101, high pressure boosted air stream 103, and intermediate pressure turbine air stream 109 through passages in integrated core 1, which are in heat exchange relationships with passages of integrated core 1 containing exiting process streams, including waste nitrogen stream 143, gaseous oxygen stream 172, and nitrogen product stream 124 in the section 2 (the warm end) of integrated core 1. Through the heat exchange relationships, each of air streams 101, 103, and 109 is cooled as they travel through integrated core 1.

Intermediate pressure air stream 109, which typically ranges from about 125 to about 200 psia and comprises about 7 to about 15% of the total feed air flow, exits integrated core 1 as stream 110 after reaching a temperature that is preferably in the range of about 140 to about 160 K; however, the temperature may depend on the amount of refrigeration required in a particular design. Preferably, cooled air stream 110 is expanded in expander 10 to form stream 119, which generates the refrigeration for the plant to compensate for various sources of refrigeration loss and heat leakage into the process. Stream 119 may also be used for additional refrigeration required to provide any liquid products (not shown). In this case, expanded turbine air stream 119 (typically in the range of about 19 to about 22 psia) is fed into upper column 40 to be separated.

Air stream 103 is further cooled along its passage(s) in integrated core 1. In intermediate heat transfer section 3 of integrated core 1, boosted air stream 103, which is typically in the range from about 100 to about 450 psia and comprising about 25 to about 35% of the total feed air flow, may be condensed due to a heat exchange relationship with the passage(s) containing boiling liquid oxygen product stream 171. In section 3, stream 103 is preferably in a crossflow orientation with boiling liquid oxygen stream 171. The resulting subcooled liquid boosted air stream 104 may exit integrated core 1 at a temperature typically in the range of about 95 to about 115 K.

In this embodiment, liquid air stream 104 is split into streams 105 and 107 and throttled in valves 10A and 10B, respectively. The resulting throttled liquid air streams 106 and 108 are fed into upper column 40 and lower column 20, respectively. Stream 106 may range from 0 to 100% of the total subcooled liquid boosted air stream 104.

Lower pressure air stream 101 (preferably in the range of about 45 to about 60 psia, and about 94 to about 96 K) contains the balance of the total feed air flow. Lower pressure air stream 101 is partially condensed against boiling liquid oxygen stream 152 exiting from the bottom of the separation section 50 in heat transfer section 4 of integrated core 1. Lower pressure air stream 101 may be in a crossflow orientation with the boiling bottom liquid oxygen stream 153. Resulting partially condensed air stream 101 exits integrated core 1 (at a temperature in the range of about 90 to about 105° K) as stream 102, with its vapor fraction typically in the range from about 0.7 to about 0.8%. Stream 102 may be fed into higher pressure rectification column 20.

The higher pressure column 20 separates partially condensed feed air stream 102 and throttled subcooled liquid feed air stream 108 into an almost-pure nitrogen vapor overhead stream 121, and oxygen-rich bottom liquid stream 125. A small fraction of overhead stream 121, typically up to about 10%, may be taken as nitrogen product stream 123. Product stream 123 may enter the cold end of integrated core 1 where it is then warmed to ambient temperature against one or more of incoming streams 101, 103 and 109, before exiting integrated core 1 as stream 124.

Although an almost pure nitrogen vapor (about 90 to about 99.6% pure) product exits the top of lower column 20, the nitrogen product may be withdrawn from elsewhere in the process. Although not depicted, the nitrogen product may also be drawn from upper column 40. In that case, the high purity nitrogen product stream could be withdrawn from the top of upper column 40, and the waste nitrogen could be withdrawn from a point somewhat lower in upper column 40. Both of the nitrogen streams could then pass through integrated core 1 in separate passages.

The balance of overhead stream 121 from lower column 20, the almost pure nitrogen, may be fed into the upper column 40 as stream 122, where it is condensed in condenser/reboiler (main condenser) 30 against the bottom oxygen-rich liquid of upper column 40. The condensed stream exits main condenser 30 as condensed overhead stream 131. Stream 131 may be split into streams 132 and 133. Stream 132 (typically in the range of about 40 to about 55% of the total condensed overhead stream 131) is returned to lower column 20 for reflux.

Stream 133, the remaining fraction of stream 132, and kettle liquid stream 125 (typically about 35 mole percent oxygen), which exits the bottom of lower column 20, are indirectly cooled (to a temperature of about 80 to about 95° K) against exiting gaseous streams 142 and 123 in heat transfer section 5 along the length of the integrated stripping separation section 50 of integrated core 1. The corresponding subcooled streams 134 (corresponding to stream 133) and 126 (corresponding to stream 125) may be throttled in valves 10C and 10D, respectively, to form throttled liquid streams 135 and 127, respectively. Streams 135 and 127 may be fed into upper column 40 to be further fractionated. Preferably, stream 135 is fed into the top of upper column 40.

Upper column 40 separates streams 119, 127 and 135, into gaseous nitrogen stream 142 and bottom liquid oxygen stream 141. Boilup vapor used in lower pressure column 40 may be provided by indirectly boiling the liquid oxygen at the bottom of upper column 40 against condensing overhead stream 122 of lower column 20, as mentioned above with respect to the main condenser 30.

Product liquid oxygen stream 141 from upper column 40 may be fed into section 50 of integrated core 1. Section 50 preferably serves the function of a reboiled stripping separation column. Accordingly, a liquid fraction is further concentrated in oxygen as it flows down the length of stripping section 50 through crosscurrent contact with a stripping vapor. Vapor stream 151 exits the top of stripping section 50 and is fed into the bottom of upper column 40. In upper column 40, vapor stream 151 combines with the vapor generated by main condenser 30 and is further separated as it ascends the column.

The bottom liquid stream from stripping section 50 exits as stream 152 and then may be partially vaporized against low pressure feed air stream 102 in section 4 of integrated core 1. The resulting two-phase (partially vaporized) bottom liquid oxygen stream 153 may exit integrated core 1 to be fed into phase separator 60. Vapor stream 161 from phase separator 60, typically comprising about 40 to about 60% of stream 153, is returned to stripping section 50 to serve as the stripping vapor. The liquid fraction from phase separator 60 is pressurized using pump 70 to the desired pressure. The resulting higher pressure liquid oxygen stream 171 enters integrated core 1 at section 3. Therein, it is vaporized primarily against the boosted air stream 103 and, along with the other exiting streams 127 and 143, is warmed to ambient temperature against one or more of the other air streams 101 and 109. Stream 171 exits integrated core 1 as product oxygen stream 172.

It should be noted that phase separator 60 may be eliminated if proper process modifications are made to insure that safety issues are addressed related to boiling oxygen-rich streams to dryness in a plate-fin heat exchanger. If separator 60 is eliminated, liquid stream 152 may be taken from the bottom of stripping section 50 as the product stream, and the rest of the bottom liquid of stripping section 50 may be completely vaporized in heat transfer section 4 of integrated core 1 to provide stripping vapor to stripping section 50 (not shown). Although not depicted, liquid products can also be withdrawn from the integrated core with minimal changes in the process and design.

Figure 1B:
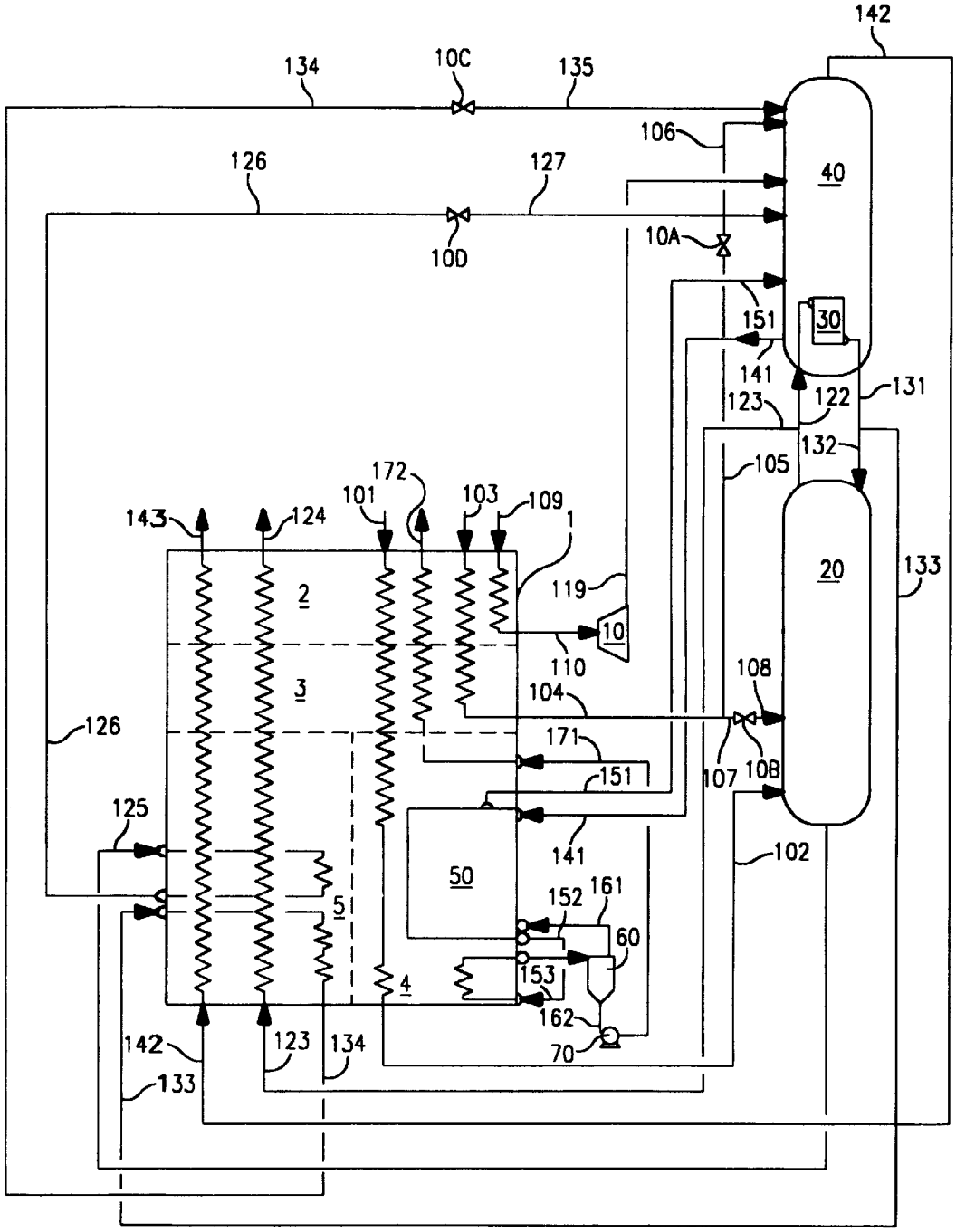
FIG. 1B shows an air separation system similar to the one shown in FIG. 1A, but with a reverse orientation.

FIG. 1B depicts an alternative arrangement of the integrated core depicted in FIG. 1A in which the directional orientation of integrated core 1 is reversed. The cold end, containing stripping section 50, is positioned at the bottom of integrated core 1, and the warm end is positioned at the top. In this configuration, air streams entering sections 2 and 3 transfer and mass transfer sections of integrated core 1 may be spatially arranged in this configuration to achieve the best overall thermodynamic characteristics with minimal labor and hardware. The remainder of the system is similar to that described with respect to the system of FIG. 1A, and will not be repeated herein.

Figure 1C:
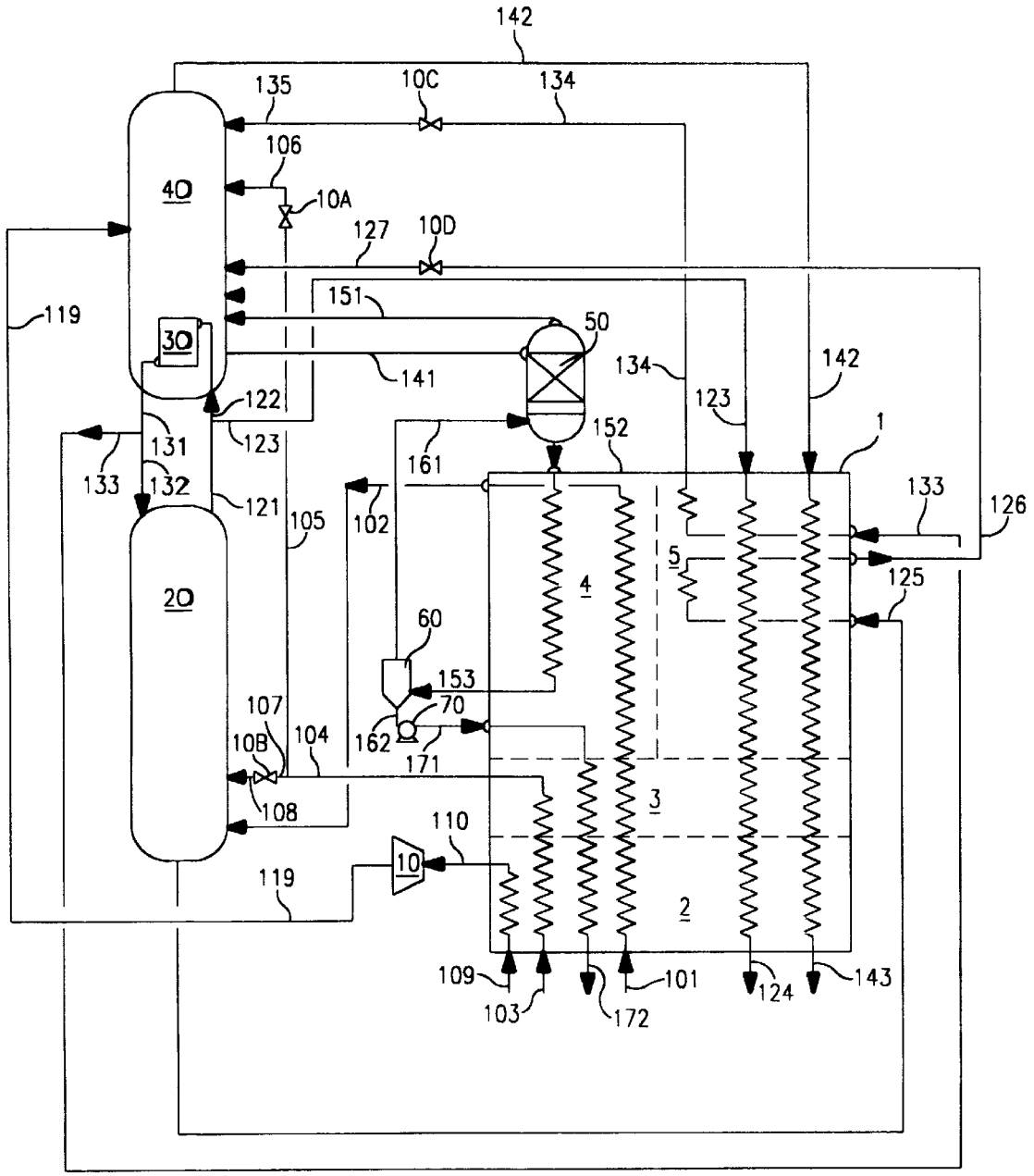
FIG. 1C shows an air separation system similar to the one shown in FIG. 1A, but with the side stripping column positioned outside of the integrated core.

FIG. 1C depicts another slight modification to the integrated core depicted in FIG. 1A. In this embodiment, stripping section 50 is positioned outside of integrated core 1 so as to be segregated from the heat transfer sections.

As depicted, integrated core 1 is vertically oriented, in terms of stream flow directions, with the cold end positioned above the warm end. However, the warm end may be situated above the cold end, as described with respect to the system in FIG. 1B. In addition, with proper accommodations in the design, the integrated core 1 may be orientated with horizontal stream flow directions. The remainder of the heat transfer network of integrated core 1 is similar to that discussed with respect to FIG. 1A.

Figure 1D:
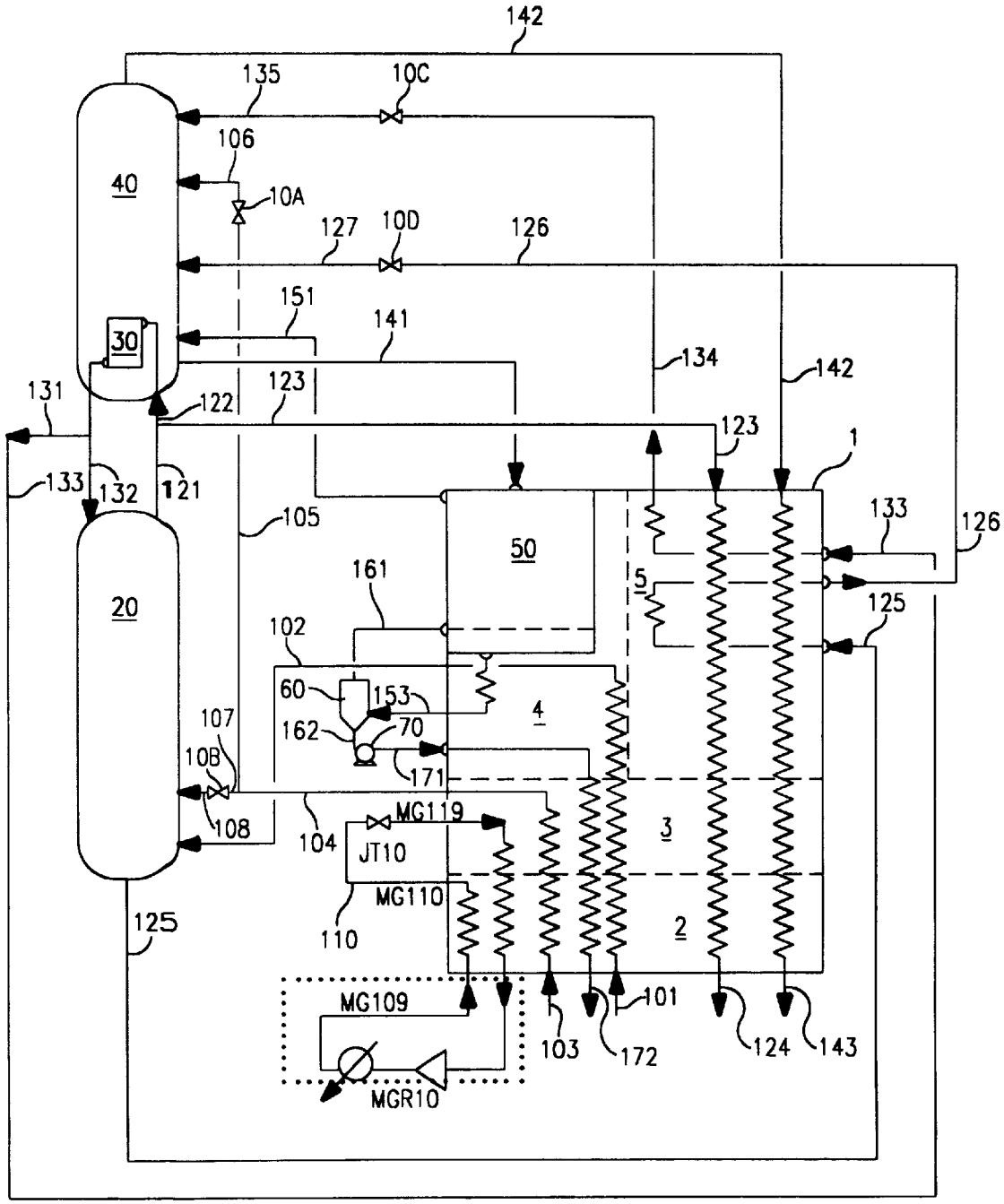
FIG. 1D shows an air separation system similar to the one shown in FIG. 1A, but with a refrigeration unit.

FIG. 1D depicts another slight modification to the air separation system depicted in FIG. 1A. Specifically, in this embodiment, integrated core 1 accommodates mixed gas refrigeration system MGR10 for the plant refrigeration, instead of expanding feed air stream 109 in turbine 10, as described with respect to the system in FIG. 1A. Accordingly, turbine air streams 109, 110, and 119 are absent in this system.

Preferably, stream MG109, the working fluid of mixed gas refrigeration system MGR10 , which includes a mixture of gases suitably selected for the particular application, enters the warm end of integrated core 1. Refrigerant stream MG109 is condensed and subcooled in section 2 of integrated core 1 against exiting process streams 123, 142, and 171, as well as exiting throttled refrigerant stream MG119, discussed below. The resulting subcooled liquid refrigerant stream MG110 may be expanded in Joule-Thompson valve JT10, preferably after reaching a temperature in the range of about 80 to about 120° K. Resulting lower pressure refrigerant stream MG119 may be returned to integrated core 1 at a point along the length of the core which is colder than where stream MG110 exits integrated core 1. The remainder of the air separation system is similar to the system described with respect to FIG. 1A.

Figure 1E:
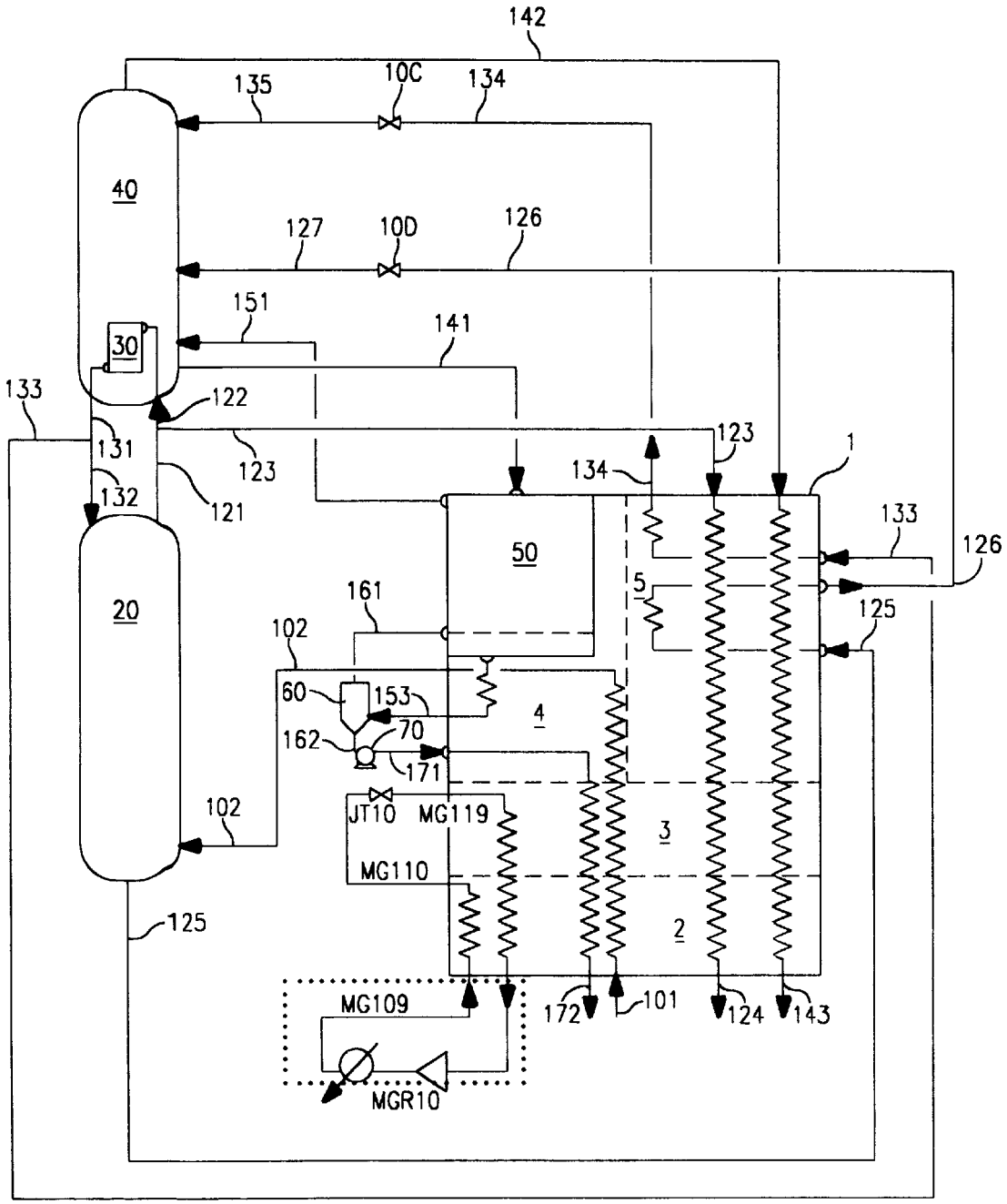
FIG. 1E shows an air separation system similar to the one shown in FIG. 1D, but without a second compensating incoming air stream.

FIG. 1E depicts yet another modification to the air separation system depicted in FIG. 1A. This system incorporates a mixed gas refrigeration system similar to that described above with respect to FIG. 1D; however, refrigerant fluid stream MG109 also may be used to boil the pressurized liquid oxygen product (stream 171). Accordingly, boosted feed air stream 103 and related streams used in the system in FIG. 1A are absent in this embodiment. Aside from the absence of boosted air streams 103–108 and the additional function of boiling stream 171, the remainder of the system is similar to the system depicted in FIG. 1D. It should be noted, however, that the exact flows and process conditions of this embodiment may differ from the other embodiments. In addition, the MGR system used to replace turbine 10 and stream 103 may include more than one refrigerant loop.

Figure 2A:
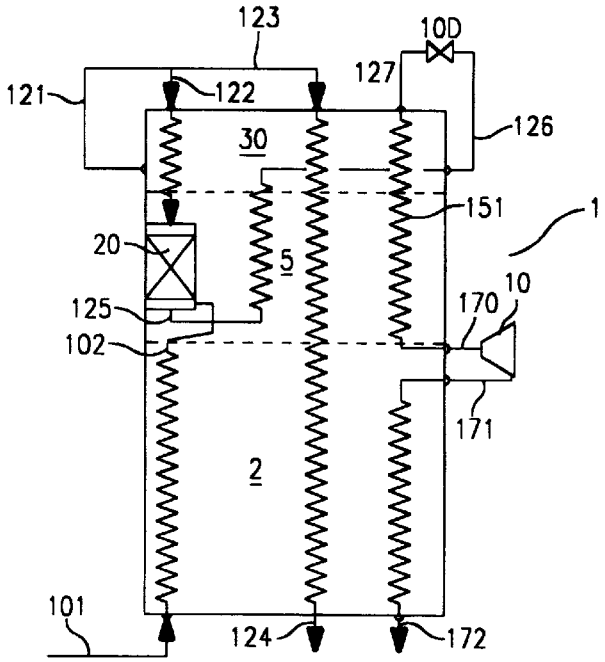
FIG. 2A shows another embodiment of an air separation system of the present invention that includes an integrated core designed for use as an air enriching/inerting grade light component plant.

FIG. 2A shows the application of the integrated core concept to an air separation system used to produce a nitrogen product and a very low purity oxygen product. Separation section 20 (preferably a rectification column) is used in the separation system and is incorporated in integrated core 1. This system uses the expansion of the low purity oxygen to provide the required plant refrigeration;

however, other process streams such as the nitrogen product stream, may be expanded for refrigeration purposes, if deemed optimal for the particular plant specifications.

As shown, pre-purified feed air stream 101, typically having a pressure in the range from about 110 to about 150 psia, is cooled to a cryogenic temperature (preferably in the range from about 80 to about 120° K) against passage(s) containing exiting nitrogen product stream 123/124 and very low purity oxygen-rich stream 171/172 in section 2 of integrated core 1. Separation section 20 of integrated core 1 separates cooled feed air stream 102 into an almost-pure nitrogen liquid overhead stream 121, and oxygen-rich bottom stream 125. A fraction of overhead stream 121 (typically about 40 to about 60%) may be taken as light component product stream 123, which is warmed to ambient temperature against stream 101 and is discharged as stream 124.

The remaining portion of stream 121 may be condensed against the throttled oxygen-rich stream 127 as overhead stream 122 in heat transfer section 30 of integrated core 1. This condensation process serves a similar function as the condenser/reboiler 30 in the system of FIG. 1A. The resulting condensed overhead stream is fed into separation section 20 for reflux, typically at a temperature of about 80 to about 90° K.

Bottom oxygen-rich liquid stream 125 exits separation section 20 and then may be indirectly cooled to a temperature of about 90 to about 120° K) against exiting gas stream 151 (preferably very low purity oxygen) in heat transfer section 5. Stream 125 then exits integrated core 1 as stream 126. Stream 126 may be throttled in valve 10D to form stream 127, which is returned to integrated core 1 at heat transfer section 30 as stream 151. Stream 151 may be vaporized against stream 122 and superheated (to a temperature of about 80 to about 100° K) in section 5. Superheated stream 151 exits the integrated core 1 as stream 170, where it may be expanded in turbine/expander 10 to provide the required plant refrigeration. Resulting expanded stream 171 is returned to integrated core 1 and is warmed to ambient temperature against incoming feed air stream 101.

Figure 2B:
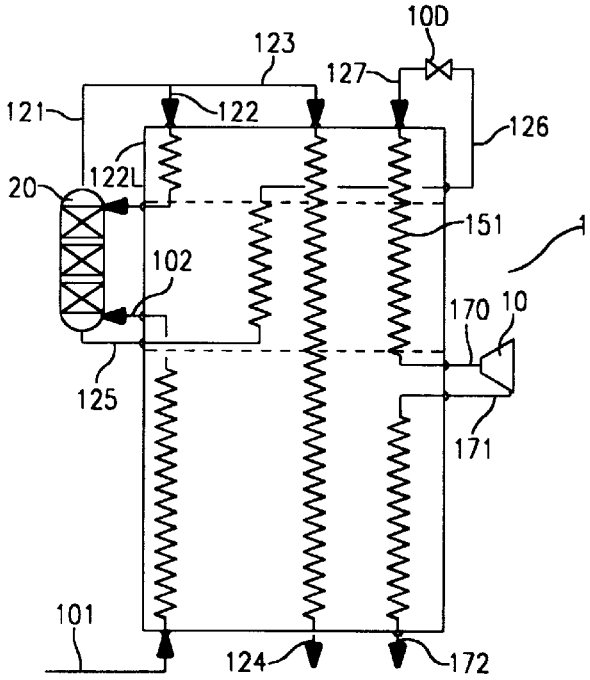
FIG. 2B shows an air separation system similar to the one shown in FIG. 2B, but with the separation section positioned outside of the integrated core.

FIG. 2B depicts an alternative configuration of the process depicted in FIG. 2A. In this embodiment, section 20 which is positioned outside of integrated core 1 (equivalent to separation section 20 of FIG. 2A) is used to separate the feed air into almost-pure nitrogen stream 121 and oxygen-rich bottom liquid stream 125. Except for section 20 being positioned outside of integrated core 1, the rest of the system is similar to the system depicted in FIG. 2A, although the placement of the various heat transfer sections of integrated core 1 may differ slightly.

Figure 3A:
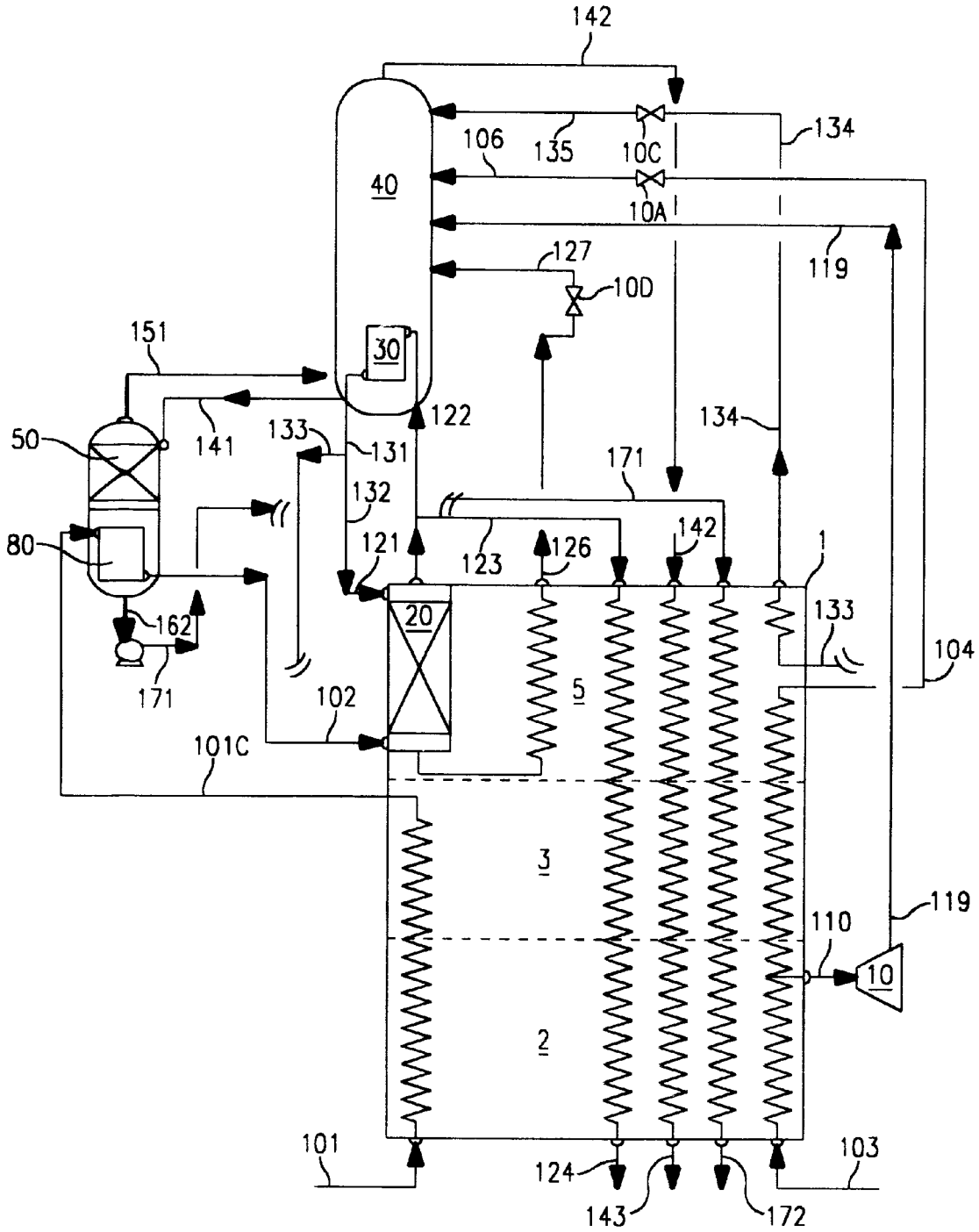
FIG. 3A shows another embodiment of the present invention in which the integrated core of the air separation system incorporates part of a double column stripping apparatus.

FIG. 3A depicts an alternative application of the integration concept to a cryogenic air separation system. Specifically, FIG. 3A shows a system in which higher pressure column 20 is integrated with the superheater, oxygen product boiler, and the primary heat exchanger in integrated core 1, instead of stripping section 50 (as in the case of the system shown in FIG. 1A). In addition, heat transfer section 4, which typically serves as a reboiler for section 50, is not present in the integrated core of this embodiment. Instead, auxiliary stripping section 50 and its reboiler 80 are situated outside of integrated core 1. However, stripping section 50 may be eliminated altogether with some process modification. In such a modified system, the liquid stream from the bottom of upper column 40 would meet the oxygen product purity requirement without the need for further enrichment, which is typically provided by stripping section 50. Other than the rearrangement of higher pressure column 20 and stripping section 50, the system shown in FIG. 3A is similar to the system of FIG. 1A.

Figure 3B:
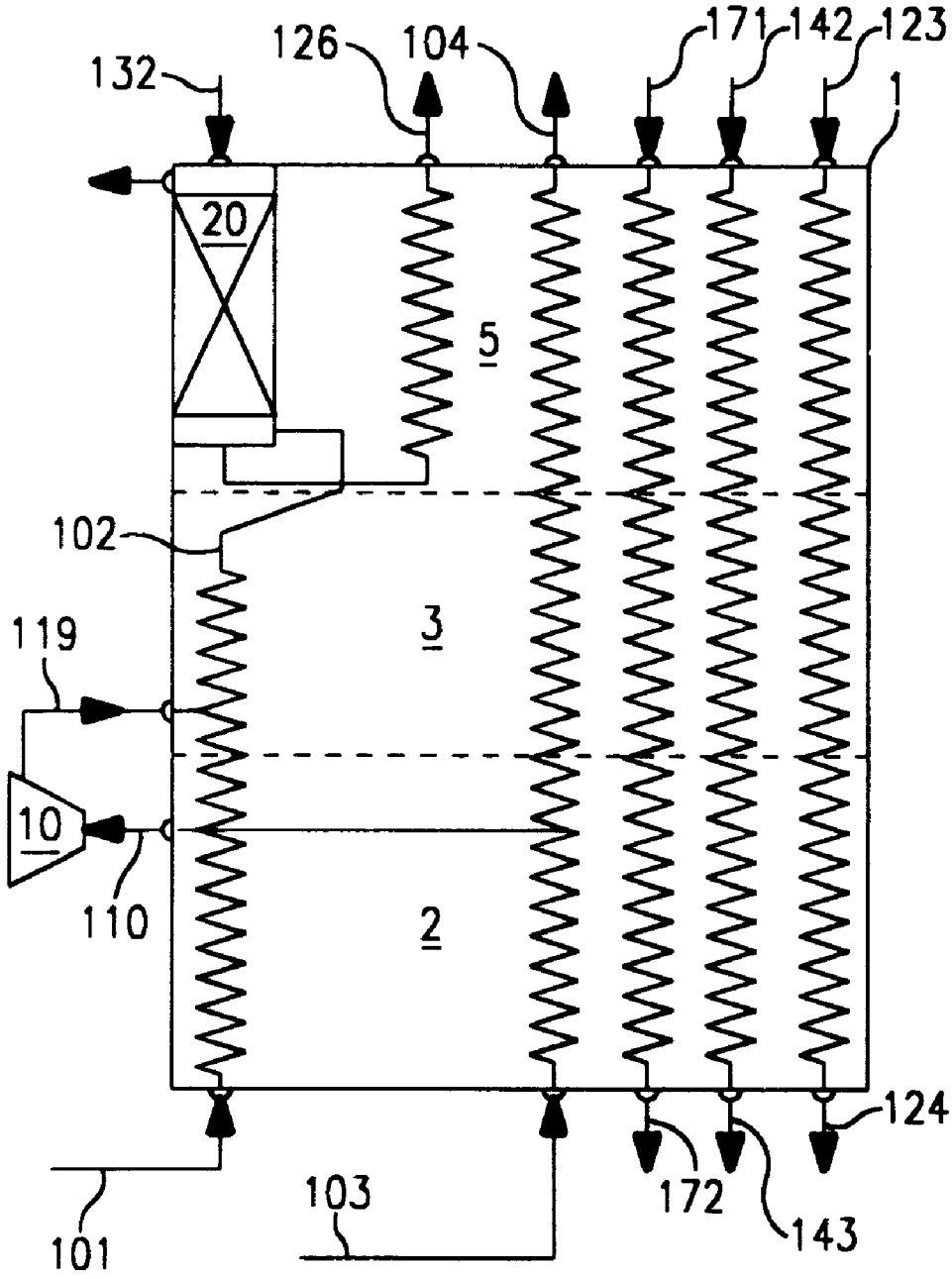
FIG. 3B shows an air separation apparatus similar to the one shown in FIG. 3A, but with the incoming feed air being directed into the stripping column in the integrated core.

FIG. 3B depicts integrated core 1 in the case where stripping section 50 is eliminated. Lower pressure feed air stream 102 enters higher pressure section 20 of integrated core 1 directly from heat transfer section 3 of integrated core 1 as a slightly superheated vapor (typically having a temperature of about 90 to about 110° K) or a close to saturated vapor. Upper column 40 is not shown in FIG. 3B for sake of convenience. As in the case with the system depicted in FIG. 1A, integrated core 1 of FIGS. 3A and 3B may be modified to accommodate the most suitable directional orientation, as well as the optimal scheme to provide the plant refrigeration requirements.

Figure 4:
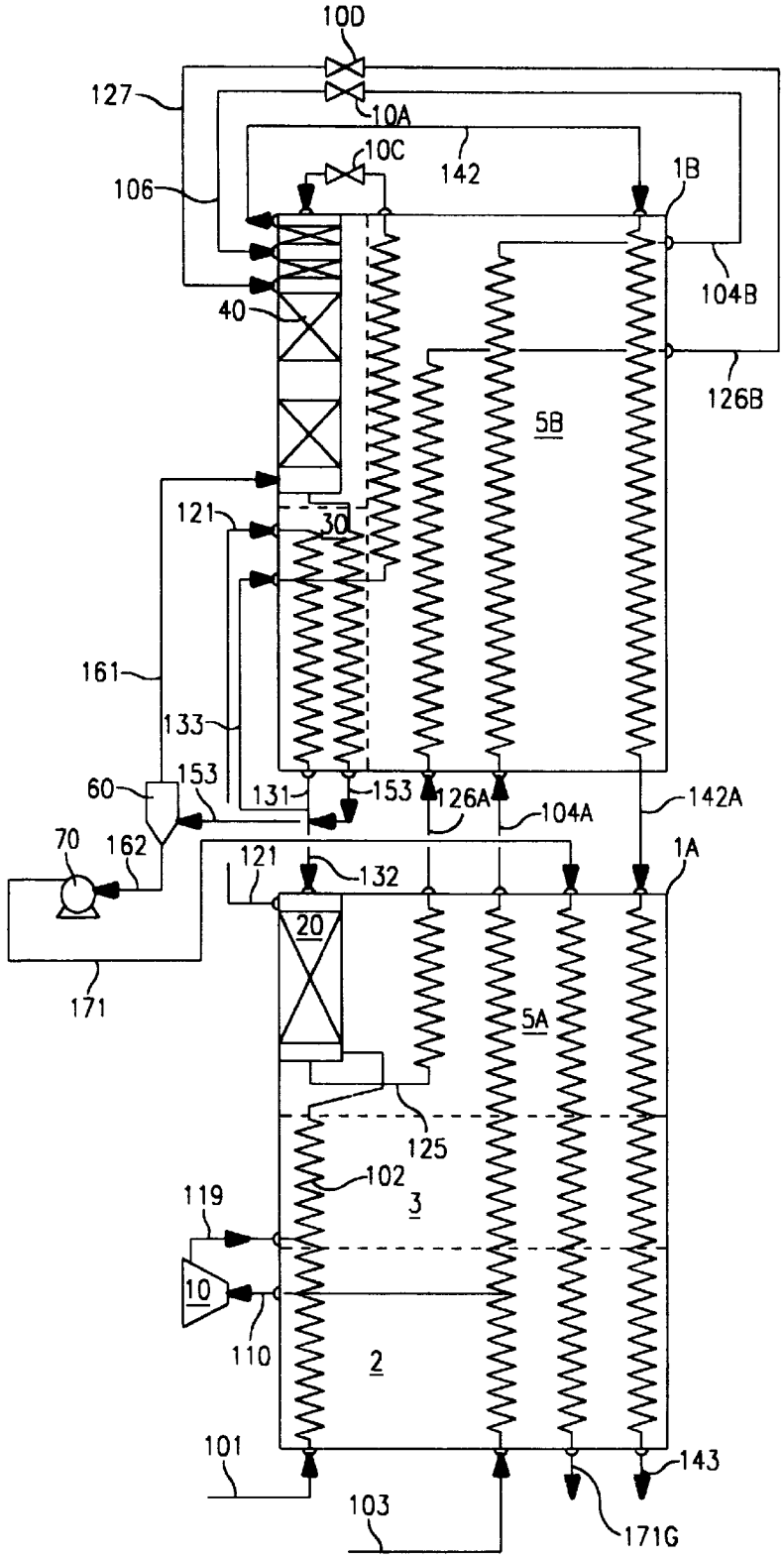
FIG. 4 shows another embodiment of an air separation system of the present invention that utilizes two integrated cores.

FIG. 4 depicts yet another embodiment of the present invention. In this embodiment, lower pressure section 40 and higher pressure section 20 are integrated into separate integrated heat transfer cores 1B and lA, respectively. Thus, in addition to integrated core 1A, which is similar to integrated core 1 depicted in FIG. 3B, integrated core 1B may also be utilized for heat and mass transfer by performing functions similar to those of main condenser 30 and upper column 40 of FIG. 1A.

The air separation system of this embodiment does not use a side-stripping column or reboiler. Instead, the system operates so that the liquid stream at the bottom of lower pressure section 40 of integrated core 1B is provided at the desired oxygen product purity. The remainder of the system is similar to that depicted in FIG. 1A except: (a) lower pressure separation section 40 (integrated in core 1B) and higher pressure separation section 20 (integrated in core 1A) take the place of upper column 40 and lower column 20; (b) heat transfer section 30 of integrated core 1B thermally links higher pressure separation section 20 and lower pressure separation section 40, of integrated cores 1A and 1B, respectively, instead of using a typical reboiler/condenser; (c) kettle liquid stream 125 and condensed nitrogen stream 133 are subcooled against exiting gas streams in heat transfer zone 5A of integrated core 1A and in heat transfer section 5B of integrated core 1B, as opposed to being subcooled in a single heat transfer section; (d) phase separator 60 separates partially vaporized stream 153, which exits from heat transfer section 30 of integrated core 1B instead of heat transfer section 4 of integrated core 1 in FIG. 1A.

Additionally, liquid stream 162 from phase separator 60 constitutes the liquid oxygen product and is fed to pump 70, in the same manner as is depicted in FIG. 1A; however, vapor stream 161 is returned as stripping vapor to lower pressure section 40, as opposed to the separation section 50, as depicted in FIG. 1A.

Figure 5:
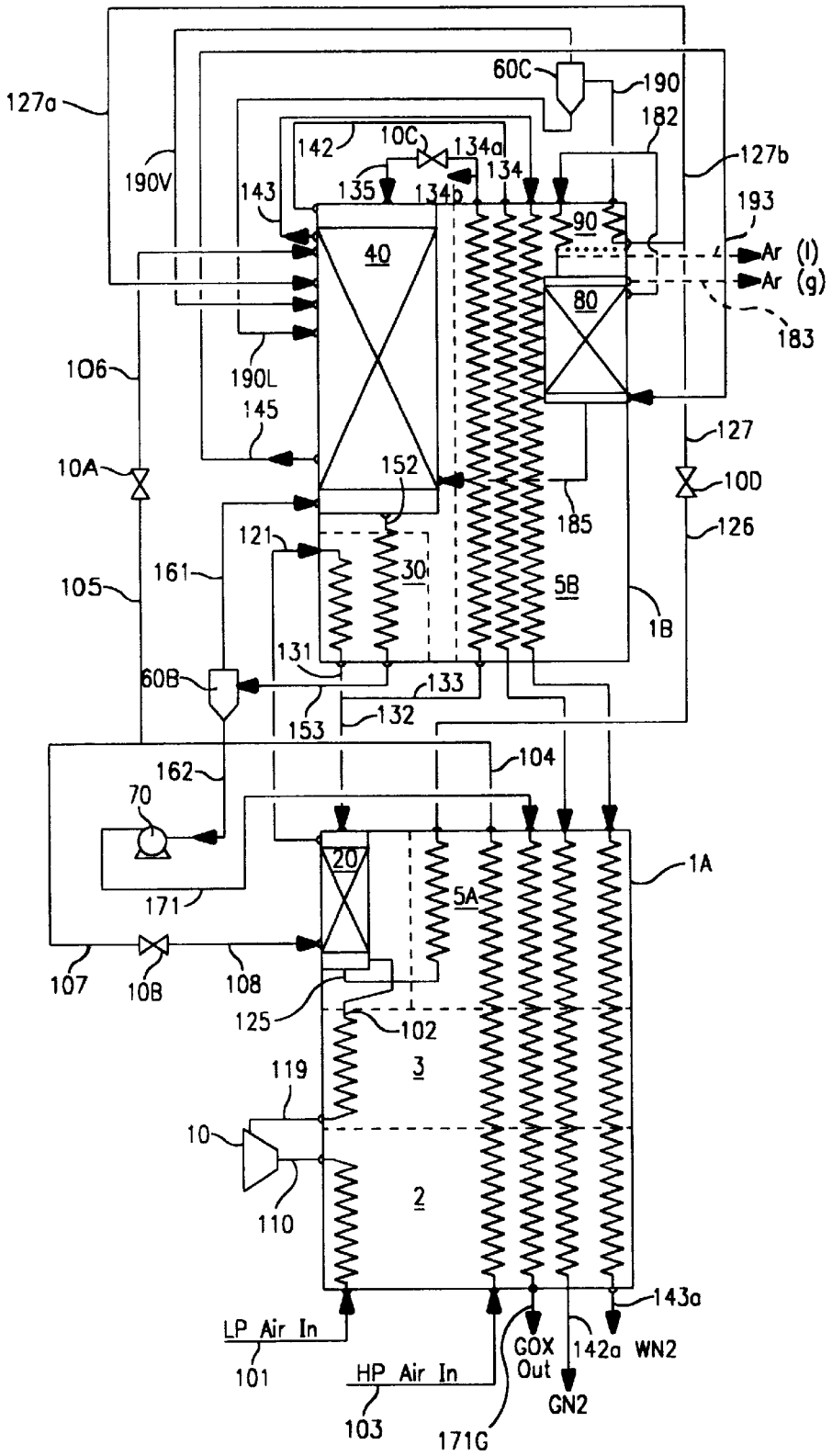
FIG. 5 shows an air separation system similar to the one shown in FIG. 4, but with an argon separation section incorporated into the second integrated core.

FIG. 5 illustrates the application of the integration concept of the present invention to an argon-producing cryogenic air separation system. FIG. 5 shows a system containing three separation sections, although more may be used. Integrated core 1B, with lower pressure separation section 40, is similar to that depicted in FIG. 4, but is modified to incorporate argon rectification section 80 and its condenser. In addition, integrated core 1A is similar to integrated core 1A of the system depicted in FIG. 4.

Pre-purified air streams 101 and 103 enter the warm end of heat exchanger core 1A. Main air stream 101 may be cooled against nitrogen product stream 143*a*, waste nitrogen stream 142*a*, and oxygen product stream 171G. Cooled air stream 110 is taken from an intermediate location along the length of integrated core 1A and is fed through turbine/ expander 10. (The specific pressure and temperature at which air stream 110 is removed depends at least in part on the plant's particular refrigeration requirement.) Resulting expanded air stream 119 enters the section 3 of integrated core 1A where it is further cooled before being fed into the bottom of section 20, preferably at a temperature of about 85 to about 105° K. Section 20 functions as the lower column in FIG. 1A.

Air stream 103 flows into integrated core 1A and may be condensed mainly against boiling oxygen product stream 171G and subcooled in heat transfer sections 3 and 5A along the length of integrated core 1A. Resulting subcooled liquid air stream 104 exits integrated core 1A (preferably at a temperature of about 90 to about 110° K) where it may be divided into streams 105 and 107. Stream 107, which may comprise 0 to 100% of stream 104, may be throttled in valve 10B. Resulting throttled liquid air stream 108 is fed into section 20 at a position several stages above the feed point of lower pressure air stream 102.

Stream 105, including the remaining portion of liquid air stream 104, is throttled in valve 10A. Resulting throttled liquid air stream 106 is fed into section 40 below the stage from which waste nitrogen stream 142 is drawn. Section 40 serves as upper column 40 as in FIG. 1A.

Feed air streams 102 and 108, which both enter separation section 20 of integrated core 1A, are separated into nearly pure nitrogen stream 121, and kettle liquid stream 125. Stream 121 may be condensed in main condenser 30 against boiling oxygen stream 152 from the bottom of separation section 40 to form stream 131. Stream 131, after exiting main condenser 30, is divided into streams 132 and 133. Stream 132, which typically includes about 45 to about 60% of stream 131, may be used as reflux for separation section 20. Stream 133, comprising the balance of stream 131, may be subcooled against exiting gaseous nitrogen streams 143 and 142 in heat transfer section 5B of integrated core 1B to a temperature of about 80 to about 100° K. Resulting subcooled liquid nitrogen stream 134 may be divided into stream 134*a* and stream 134*b*.

Stream 134*b*, preferably the major fraction of stream 134, may be throttled in valve 10C to form throttled stream 135. Stream 135 preferably enters the top of separation section 40 as reflux. Stream 134*a*, the remainder of stream 134, may be taken as product liquid nitrogen.

Kettle liquid stream 125 from separation section 20 may be subcooled against exiting gaseous streams 143*a* and 142*a* in heat transfer section 5A at the cooler end of integrated core 1A. Resulting stream 126 may be throttled in valve 10D, outside of integrated core 1A, and split into two streams. Preferably, stream 127*a*, a smaller fraction of stream 126, enters section 40 a few stages below the feed point of stream 106. The other fraction, stream 127*b*, which may include 0 to 100% of stream 126, may be fed into heat transfer section 90 at the colder end of integrated core 1B.

Heat transfer section 90 serves as an argon condenser. In heat transfer section 90, stream 127*b* may be vaporized against condensing argon vapor overhead stream 180 from argon rectification section 80 of integrated core 1B. Resulting, mostly-vapor stream 190 may be fed to phase separator 60C and separated into stream 190L and stream 190V. Stream 190V, which is less rich in oxygen, may be fed into separation section 40 a few stages below the feed position of stream 127*a*. Preferably, stream 190L is fed into separation section 40 even lower than stream 190V.

In separation section 40, feed streams 106, 127*a*, 190L, and 190V, along with liquid stream 185 from the bottom of argon rectification section 80, are separated into high purity nitrogen product stream 142, high purity liquid oxygen stream 152, waste nitrogen stream 143, and argon-rich vapor stream 145, respectively. Argon-rich stream 145, preferably containing about 10% to about 15% argon, feeds into argon rectification section 80 to be further separated.

Stream 142 typically contains less than 2 ppm of oxygen, and stream 152 typically is about 99.5% oxygen. Streams 143 and 142 may be superheated (to a temperature of about 80 to about 100° K) against almost-pure nitrogen stream 134 in integrated core 1B, and then may be transferred into integrated core 1A where those streams may be warmed to near ambient temperature.

In heat transfer section 30 of integrated core 1B, stream 152 may be vaporized against stream 121 from separation section 20. Resulting partially vaporized, almost-pure oxygen bottom stream 153 may be fed into separator 60B, in which it may be separated into vapor stream 161 and liquid stream 162. Vapor stream 161 may be returned as stripping vapor to the bottom of separation section 40. Stream 162 may be pumped to the desired pressure through pump 70 to form stream 171 (which typically has a pressure in the range of about 60 to about 100 psia). A small fraction of the pressurized liquid oxygen stream 171 may be withdrawn as a product stream (not shown). The balance, stream 171G, is fed through integrated core 1A where it may be vaporized in heat transfer section 3 against condensing air stream 103. Preferably, stream 171G is warmed to near ambient temperature before being discharged from integrated cre 1A.

Argon-rich vapor stream 145, withdrawn at about 30 to about 40 stages from the bottom of the separation section 40 and typically containing about 10 to about 15% argon and nitrogen in ppm level, is sent to the bottom of separation section 80 of second integrated core 1B. Argon separation section 80 further enriches vapor feed stream 145 in argon, resulting in an argon overhead product, typically containing about 1 to about 3% oxygen, and a less argon-rich bottom liquid stream 185.

Bottom liquid stream 185 may be returned to separation section 40. A portion of the overhead argon from separation section 80 may be taken as vapor argon product (stream 183) and the rest (stream 182) may be condensed against stream 127*b* in reboiler/condenser section 90. A small fraction of the resulting condensed overhead stream may be taken as liquid crude argon product, as stream 193. The balance of condensed overhead stream 182 preferably is returned as reflux to argon separation section 80.

If the argon product from the rectification column is required to meet heavy component impurity specifications of a few ppm, another column (not shown) comprising higher stages (lower temperatures) than the single argon column featured in FIG. 5 can be added to further rectify the argon-rich vapor. In this case, argon-rich vapor may flow from the top of section 80 to the bottom of the additional rectification section and then continue upward. Liquid from the bottom of the additional section may be pumped to the top of section 80. Liquid argon may be withdrawn as product argon several stages from the top of the added section in order to meet the required ppm level of oxygen and nitrogen impurities.

A small vapor stream may be removed from the top of the added column section to prevent nitrogen buildup in the argon rectification sections. An overhead argon stream to be condensed in argon condenser 90 then may be taken from the top of the added column section instead of section 80 of integrated core 1B. In any case, integrated cores 1A and 1B may be designed for optimal thermal interaction between the various heat transfer and mass transfer zones of the integrated cores.

We claim:

1. A cryogenic air separation system in flow communication with a double column separation apparatus having a higher pressure column and a lower pressure column, said air separation system comprising:

an integrated core comprising:

(i) a first intake passage cooling a first incoming feed air stream, and directing the cooled first incoming feed air stream into the separation apparatus, said first intake passage being in a heat exchange relationship with at least one other passage of said integrated core, (ii) a first cooling passage cooling a first bottom stream from the separation apparatus, and directing the cooled first bottom stream back into a separation section, said first cooling passage being in a heat exchange relationship with at least one other passage of said integrated core, (iii) a first warming passage warming a first overhead stream from the separation apparatus, and discharging the warmed first overhead stream from said integrated core, said first warming passage being in a heat exchange relationship with at least one other passage of said integrated core, and (iv) a vaporization passage vaporizing a liquid phase stream and discharging the vaporized liquid phase stream from said integrated core, said vaporization passage being in a heat exchange relationship with at least one other passage of said integrated core; and a separating section separating a second bottom stream from the separation apparatus to form an oxygen enriched stream and a nitrogen enriched stream, wherein the nitrogen enriched stream is directed back into the separation apparatus and the oxygen enriched stream is separated into a vapor phase stream and the liquid phase stream, the vapor phase stream being directed back into said separating section.

2. The air separation system according to claim 1, wherein said separating section is integrated within said integrated core and wherein said integrated core further comprises a second cooling passage cooling a condensed stream from the lower pressure column, and directing the cooled condensed stream back into the separation apparatus, said second cooling passage being in a heat exchange relationship with at least one other passage of said integrated core.

3. A method for separating air comprising the steps of:

cooling, in an integrated core, a first incoming feed air stream against at least one other stream flowing through the integrated core, and directing the cooled incoming feed air stream into a separation apparatus;

cooling, in the integrated core, a first bottom stream from the separation apparatus against at least one other stream flowing through the integrated core, and directing the cooled first bottom stream back into the separation apparatus;

warming, in the integrated core, a first overhead stream from the separation apparatus against at least one other stream flowing through the integrated core, and discharging the warmed first overhead stream from the integrated core;

vaporizing, in the integrated core, a liquid phase stream against at least one other stream in the integrated core, and discharging the vaporized liquid phase stream from the integrated core;

separating a second bottom stream from the separation apparatus to form an oxygen enriched stream and a nitrogen enriched stream; and feeding the nitrogen enriched stream back into the separation apparatus; and further separating the oxygen enriched stream into a vapor phase stream and the liquid phase stream.

4. The method according to claim 3, wherein the step of separating the second bottom stream is performed within the integrated core.

* * * * *

UNITED STATES PATENT AND TRADEMARK OFFICE

CERTIFICATE OF CORRECTION

PATENT NO. : 6,295,836 B1
DATED : October 2, 2001
INVENTOR(S) : Nguyen et al.

It is certified that error appears in the above-identified patent and that said Letters Patent is hereby corrected as shown below:

Title page,
Item [75], Inventors add -- Kenneth Kai Wong, Amherst, NY (US); John Fredric Billingham, Getzville, NY (US) --.

Signed and Sealed this

Fourteenth Day of May, 2002

*Attest:*

*Attesting Officer*

JAMES E. ROGAN
*Director of the United States Patent and Trademark Office*